US007258709B2

(12) United States Patent
Ponjican et al.

(10) Patent No.: US 7,258,709 B2
(45) Date of Patent: Aug. 21, 2007

(54) VACUUM CLEANER BAG DOCKING ASSEMBLY

(75) Inventors: Samuel Ponjican, Gulfport, MS (US); Charles W. Reynolds, Long Beach, MS (US); Christopher M. Paterson, Biloxi, MS (US); Dennis T. Lamb, Long Beach, MS (US); Paul A. Moshenrose, Ocean Springs, MS (US)

(73) Assignee: Oreck Holdings, Cheyenne, WY (US)

( * ) Notice: Subject to any disclaimer, the term of this patent is extended or adjusted under 35 U.S.C. 154(b) by 128 days.

(21) Appl. No.: 11/349,800

(22) Filed: Feb. 8, 2006

(65) Prior Publication Data

US 2006/0123746 A1 Jun. 15, 2006

Related U.S. Application Data

(63) Continuation of application No. 10/238,471, filed on Sep. 10, 2002, now Pat. No. 7,024,724.

(51) Int. Cl.
*A47L 5/28* (2006.01)

(52) U.S. Cl. ..... 55/374; 55/376; 55/377; 55/378; 55/DIG. 2; 15/350; 15/351; 15/347; 15/DIG. 8

(58) Field of Classification Search ..... 15/347, 15/350, 351, DIG. 8; 55/373, 377, DIG. 2, 55/DIG. 3, 374, 376, 378
See application file for complete search history.

(56) References Cited

U.S. PATENT DOCUMENTS

| | | | | |
|---|---|---|---|---|
| 5,935,280 | A * | 8/1999 | Lee | 55/378 |
| 6,033,451 | A * | 3/2000 | Fish et al. | 55/374 |
| 6,406,507 | B1 * | 6/2002 | Paterson et al. | 55/378 |
| RE38,842 | E * | 10/2005 | Fish et al. | 55/374 |
| 7,024,724 | B2 * | 4/2006 | Ponjican et al. | 15/347 |

* cited by examiner

*Primary Examiner*—Minh-Chau T. Pham
(74) *Attorney, Agent, or Firm*—The Ollila Law Group LLC

(57) ABSTRACT

An improved bag docking assembly for aligning a vacuum bag for engagement with a dirty air outlet nozzle on a vacuum cleaner, and for retaining the vacuum bag in the position of engagement. The assembly incorporates an anchor member and a mounting member. The anchor member serves to attach the bag docking assembly to the vacuum cleaner. The anchor member can be a substantially flat piece of plastic having a central opening for closely receiving the dirty air outlet nozzle on the vacuum cleaner. The central opening can have a shoulder for engaging a rim or similar protrusion formed about the perimeter of the dirty air outlet nozzle. Additionally, protrusions are located on the anchor member that align with voids in the vacuum bag collar to ensure that correct alignment of the vacuum bag has been achieved.

24 Claims, 7 Drawing Sheets

VACUUM CLEANER BAG DOCKING ASSEMBLY

RELATED APPLICATIONS

This application is a continuation of pending application Ser. No. 10/238,471, filed Sep. 10, 2002, entitled, "VACUUM CLEANER BAG DOCKING ASSEMBLY," now U.S. Pat. No. 7,024,724 B2 hereby incorporated by reference into this application.

TECHNICAL FIELD

The invention is directed to a bag docking assembly and, more particularly, to an assembly for docking a vacuum bag in the proper orientation for engagement with a dirty air outlet nozzle on a vacuum cleaner, and for retaining the vacuum bag in the position of engagement.

BACKGROUND OF THE INVENTION

Vacuum cleaners, such as upright vacuums, remove dirt from a carpet by creating a suction strong enough to draw the dirt particles from a section of the carpet up into the vacuum cleaner where the dirty air is passed through a vacuum bag in which the entrained dirt is captured. To increase the efficiency of this process, a base portion of the vacuum cleaner often has a roller brush for agitating dirt from the carpet as it is being vacuumed.

Inside the vacuum cleaner, a dirty air conduit transfers the dirty air from the base of the vacuum cleaner to the vacuum bag. The dirty air conduit runs up a handle assembly or, in cases where the dirty air conduit is rigid, the dirty air conduit can itself function as a portion of the handle. At the end of the dirty air conduit opposite the floor there is a dirty air outlet nozzle where the dirty air exits from the dirty air conduit. The vacuum bag is attached to the dirty air outlet nozzle.

The vacuum bag has a bag opening that fits closely over the dirty air outlet nozzle. The vacuum bag is otherwise a completely closed bag that is made from a porous material that allows air to flow through it, but which is too fine for most dirt particles to pass through. As dirty air passes through the vacuum bag, the air is forced through the porous material and the dirt is trapped in the bag. The bag thus collects the dirt from the dirty air and, more importantly, from the floor. Because the material of the vacuum bag is often fragile and can get very dusty, the vacuum bag is commonly held within a protective outer bag.

The outer bag is typically placed over the dirty air outlet nozzle first, with the dirty air outlet nozzle extending through a hole in the outer bag. A clip is then placed over the dirty air outlet nozzle between the outer bag and a protrusion on the outer surface of the dirty air outlet nozzle. The clip retains the outer bag in the proper position for use. Finally, the vacuum bag is placed over the remaining length of the dirty air outlet nozzle, and the outer bag closed.

To eliminate the need for emptying or cleaning the vacuum bag after it has collected dirt, vacuum bags have been modified over the years to be disposable. This allows the user to merely discard the dirty vacuum bag and replace it with a new, clean one. To adapt the vacuum bags for easy replacement, the bags have been designed so that the bag opening can be releasably engaged with the dirty air outlet nozzle.

One common vacuum bag design incorporates a reinforced area, known as a collar, surrounding the bag opening.

The collar is usually a square or rectangular piece of thin cardboard. To install the vacuum bag, the user holds the collar by one or more edges, and forces the bag opening over the dirty air outlet nozzle. The collar can be designed with an elastic seal extending inward from the circumference of the bag opening to further seal the gap between the dirty air outlet nozzle and the bag opening.

Typically, installation of a vacuum bag is done by hand. A user inserts the vacuum bag into the outer bag, aligns the vacuum bag opening with the dirty air outlet nozzle and pushes the vacuum bag onto the nozzle. The installation of the vacuum bag by hand has obvious drawbacks including misalignment and an incomplete connection of the bag with the dirty air outlet nozzle.

An improperly installed vacuum bag can become damaged and is more likely to leak or disengage during use.

In an attempt to solve the problems of both alignment and retention, some vacuum cleaners come equipped with a bag docking assembly. Examples of bag docking assemblies are discussed in U.S. Pat. No. 5,089,038 to Kopko et al., U.S. Pat. No. 5,444,385 to Jailor et al. and U.S. Pat. No. 6,033,451 to Fish et al. Kopko et al. describes a docking system comprising a rigid housing surrounding both the vacuum bag and dirty air outlet. A hinge is integrally formed on the inside of the housing. A mounting plate holding the vacuum bag by its collar is attached to the hinge, and pivots to engage and disengage the vacuum bag from the dirty air outlet nozzle. When the mounting plate is rotated to the point of engagement, the collar on the vacuum bag seals with the dirty air outlet nozzle. When the mounting plate is rotated to the point of disengagement, a user accessing the unit from the back of the housing may remove the vacuum bag from the mounting plate and replace it with a new one.

The Fish et al. invention describes a docking system with a separate anchor and mounting member. The anchor member attaches to the dirty air outlet and is connected to the mounting member via a hinged portion. The mounting member has side walls that allow for engagement of a bag collar. When placing a vacuum bag into the docking assembly the mounting member is rotated to an open position and the vacuum bag collar is inserted into the mounting member so that the edges of the vacuum bag collar line up with the side walls. Once the vacuum bag is inserted in to the mounting member the mounting member is rotated back into contact with the anchor member.

Although the docking assemblies described are an improvement over manual placement of a vacuum bag into a vacuum, the current state of the art still exhibits problems with alignment and retention. In the prior art described, it is possible to insert the vacuum bag in orientations that were not intended by the dock manufacture. For example, it is possible for a user to insert a vacuum bag upside down or only partially, thus leaving gaps for the escape of unfiltered air or damaging the vacuum bag when the docking assembly is closed.

In addition to problems with alignment and retention, the prior art docking assemblies lack ease-of-use features that enable customers to easily replace a vacuum bag. In Fish et al., the mounting member can pivot freely, causing the vacuum bag to be compressed against vacuum forcing air and dirt out of the opening in the bag collar before the opening can be closed. Also, when attempting to remove the vacuum bag from the docking assembly it is difficult to grab hold of the bag because the top of the bag collar and the top edge of the docking assembly are at the same height leaving little space in which to grab hold of the collar. Additionally, it is difficult to insert the bag collar into the docking assembly. The docking assembly has a very narrow opening for inserting the vacuum bag collar, necessitating careful alignment when sliding the vacuum bag collar into the docking station.

A need therefore exists for an improved bag docking assembly for aligning a vacuum bag with a dirty air outlet nozzle, and for retaining the vacuum bag in the position of engagement.

SUMMARY OF THE INVENTION

It is therefore an object of this invention to provide an improved bag docking assembly for aligning a vacuum bag for engagement with a dirty air outlet nozzle on a vacuum cleaner, and for retaining the vacuum bag in the position of engagement. The invention is directed to a vacuum cleaner bag docking assembly for use with vacuum cleaner bags of the type having a substantially rigid mounting collar surrounding the bag opening. The assembly incorporates an anchor member and a mounting member.

The anchor member serves to attach the bag docking assembly to the vacuum cleaner. The anchor member can be a substantially flat piece of plastic having a central opening for closely receiving the dirty air outlet nozzle on the vacuum cleaner. The central opening can have a shoulder for engaging a rim or similar protrusion formed about the perimeter of the dirty air outlet nozzle. Additionally, protrusions are located on the anchor member that align with voids in the vacuum bag collar to ensure that correct alignment of the vacuum bag has been achieved. One edge of the anchor member can have a first hinge member, a stop for limiting motion of the mounting member or a combination of both.

The mounting member can also be fabricated from a piece of flat plastic. The mounting member can have side walls, an end wall, and channels about a portion of its perimeter for engagement with the edges of the collar. The mounting member has a central opening corresponding to the location of the opening in the vacuum bag when the collar is engaged with the mounting member. One edge of the mounting member can have a second hinge member complementary to the first hinge member on the anchor member.

During operation, the anchor member can be slid over the dirty air outlet nozzle with the central opening in the anchor member closely fitting around the perimeter of the dirty air outlet nozzle. The edge having the hinge member is preferably oriented at the bottom. The resilient material of the anchor member is forced beyond a rim or similar protrusion on the dirty air outlet nozzle, and the rim holds the anchor member in place against the handle assembly of the vacuum cleaner.

The mounting member is pivotally connected to the anchor member by engagement of the first and second hinge members. The mounting member is free to rotate over an angle of less than 180 degrees, from the point where the mounting member abuts the anchor member (the working position) to the point where the mounting member contacts the stop located on the anchor member. When the mounting member contacts the stop on the anchor member, the mounting member is in a position that is convenient for the insertion and removal of the bag collar from the mounting member (the loading position).

When the mounting member is in the loading position, the bag collar can be inserted or removed from the mounting member while in plain view of the user and without the need of the user to hold the mounting member. The edges of the bag collar slidably engage the channels in the mounting member. When the mounting member is rotated into the working position, protrusions on the anchor member align with corresponding voids on the bag collar, retaining the collar in the proper location and orientation to engage the dirty air outlet nozzle. When the mounting member is locked in the working position the bag opening engages the dirty air outlet nozzle. Because the mounting and anchor members hold the collar in the proper orientation for engagement, the user does not need to align the bag with the dirty air outlet nozzle. The user can merely pivot the mounting member against the anchor member and thereby engage the bag with the dirty air outlet nozzle. A latch is provided to lock the mounting member against the anchor member, thereby retaining the vacuum bag in the position of engagement with the dirty air outlet nozzle. The latch is designed such that it will only engage if the protrusions on the anchor portion are aligned with the voids on the vacuum bag collar. If the protrusions and voids are not aligned the latch will not close, requiring the user to correct the installation of vacuum bag.

In another embodiment, the top portion of the mounting member is tapered outwardly to allow for easier insertion of the vacuum bag collar. The tapered portion allows a user to locate the entrance of the bag dock without numerous attempts.

In an additional embodiment, the bag collar has a contoured portion on the top edge that allows a user to easily grasp the bag collar. When the bag collar is located in the docking assembly, the contoured portion of the bag collar extends above the top edge of the docking assembly, thereby allowing access to the contoured portion without interference from the docking assembly. In order to remove the vacuum bag a user simply grasps the contoured portion and pulls outward.

DETAILED DESCRIPTION OF THE INVENTION

The present invention is directed toward a vacuum cleaner bag docking assembly for docking a vacuum cleaner bag in the proper orientation for engagement with a dirty air outlet nozzle on a vacuum cleaner, and for retaining the vacuum bag in the position of engagement. Many specific details of certain embodiments of the invention are set forth in the following description and in FIGS. 1–9 to provide a thorough understanding of such embodiments. One skilled in the art, however, will understand that the present invention may have additional embodiments, or that the invention may be practiced without several of the details described in the following description.

Figure 1:
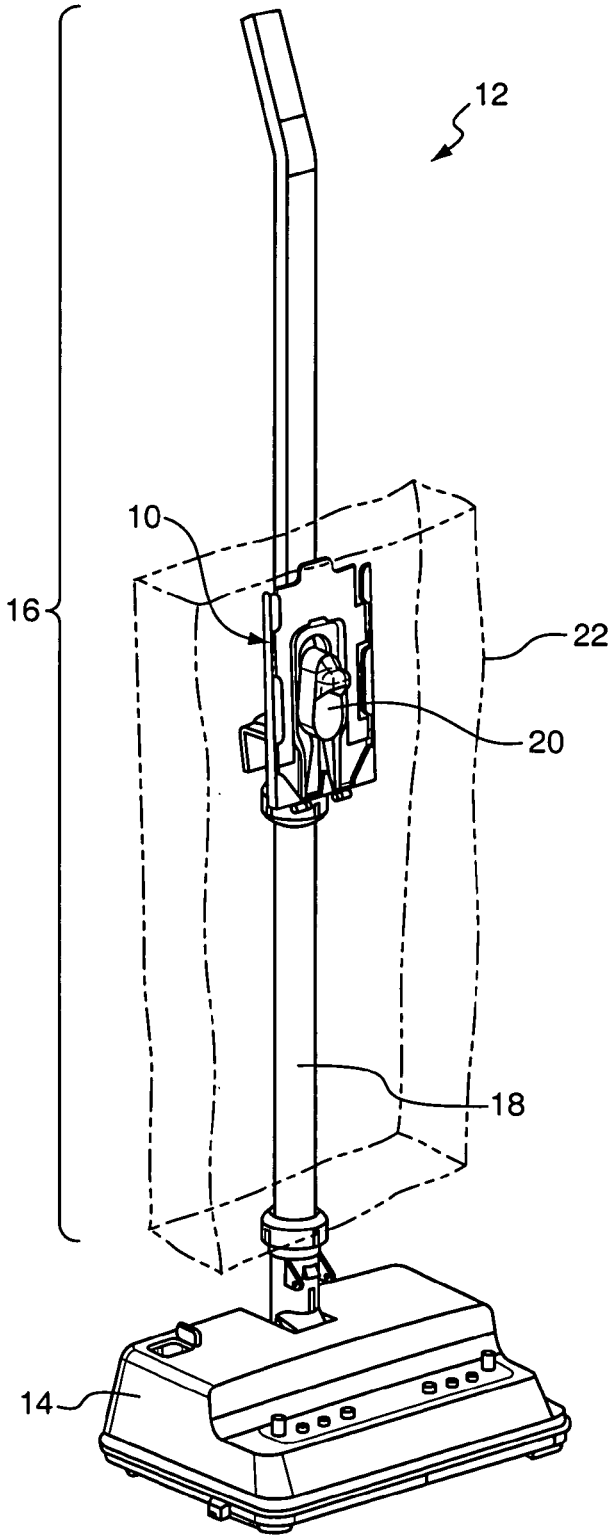
FIG. 1 PRIOR ART
FIG. 1 is an isometric view of a vacuum cleaner incorporating a bag docking assembly according to the prior art.

FIG. 1 shows a bag docking assembly 10 according to the prior art in a position of engagement with an upright vacuum cleaner 12. The vacuum cleaner 12 has a base 14 and a handle assembly 16. In this disclosure, a portion of the handle assembly 16 is a hollow tube serving as a dirty air conduit 18. The dirty air conduit 18 connects the base 14 with a dirty air outlet nozzle 20. The dirty air conduit 18 can also be independent of the handle assembly 16. The bag docking assembly 10 is preferably removably attached to the dirty air outlet nozzle 20. A protective, outer bag 22 can be positioned around both the dirty air outlet nozzle 20 and the bag docking assembly 10.

Figure 2:
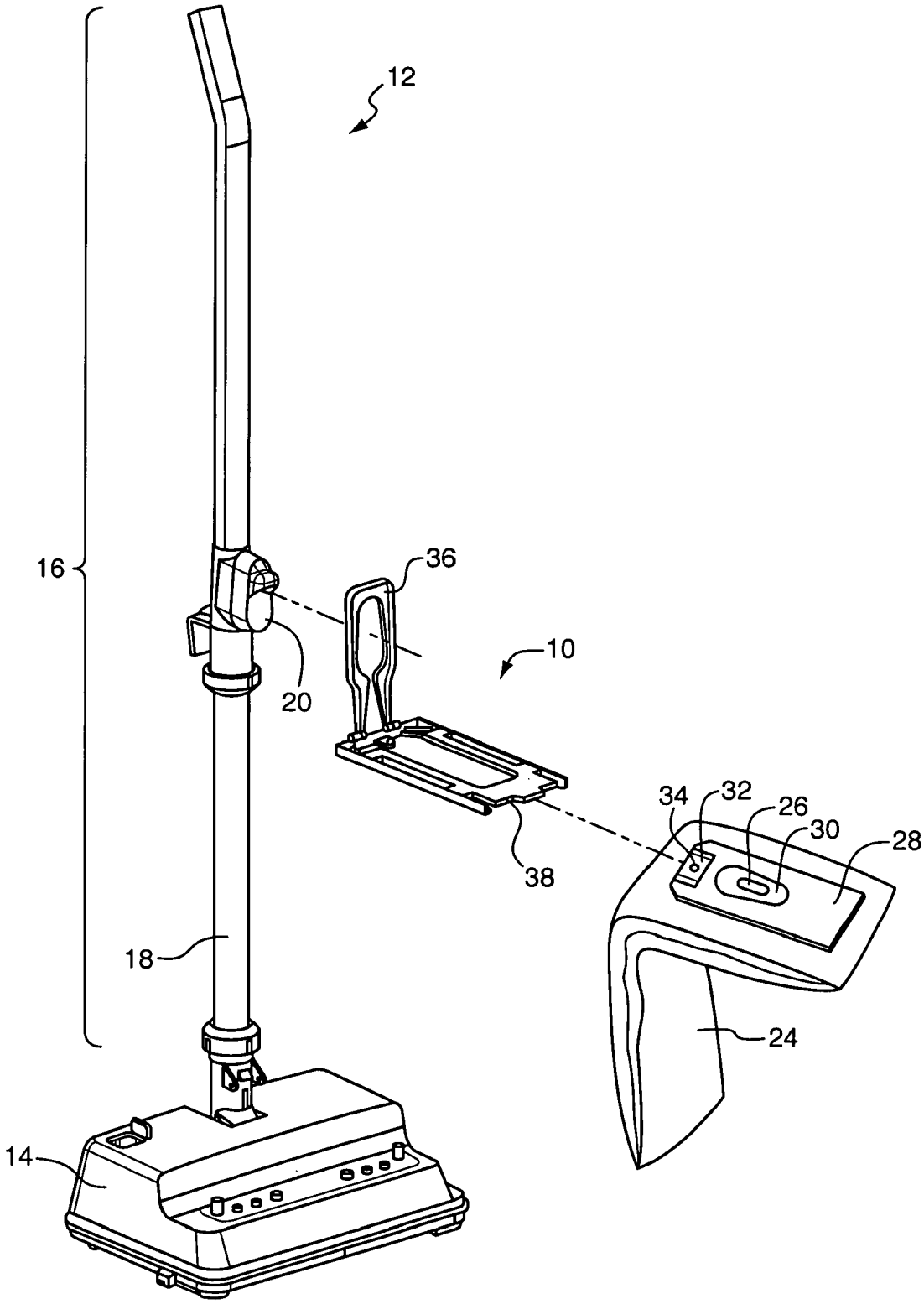
FIG. 2 PRIOR ART
FIG. 2 is an exploded isometric view of a vacuum cleaner bag and a vacuum cleaner incorporating a bag docking assembly according to the prior art.

FIG. 2 shows an exploded view of a vacuum bag 24 positioned to engage the bag docking assembly 10, and the bag docking assembly 10 positioned to engage the dirty air outlet nozzle 20 on the vacuum cleaner 12. The vacuum bag 24 has a bag opening 26 through which dirty air enters the vacuum bag 24 for collection of entrained dirt. The bag opening 26 is surrounded by a reinforced collar 28. The bag opening 26 can also be surrounded by an elastic seal 30 to create a more air-tight seal when the vacuum bag 24 is engaged with the dirty air outlet nozzle 20. The vacuum bag 24 may also be designed to have a sliding panel 32 that slides between an opened position and a closed position over the bag opening 26 to prevent spillage when the vacuum bag 24 is disengaged from the vacuum cleaner 12. A retainer opening 34 is located on the sliding panel 32 to provide a grip for retaining the collar 28 and for moving the sliding panel 32.

The bag docking assembly 10 incorporates an anchor member 36 and a mounting member 38. Generally, the anchor member 36 retains the bag docking assembly 10 to the vacuum cleaner 12. The mounting member 38 is pivotally attached to the anchor member 36. The mounting member 38 pivots between a loading position, in which the collar 28 of the vacuum bag may be engaged or disengaged with the mounting member 38, and a working position, in which the bag opening 26 engages the dirty air outlet nozzle 20.

Figure 3:
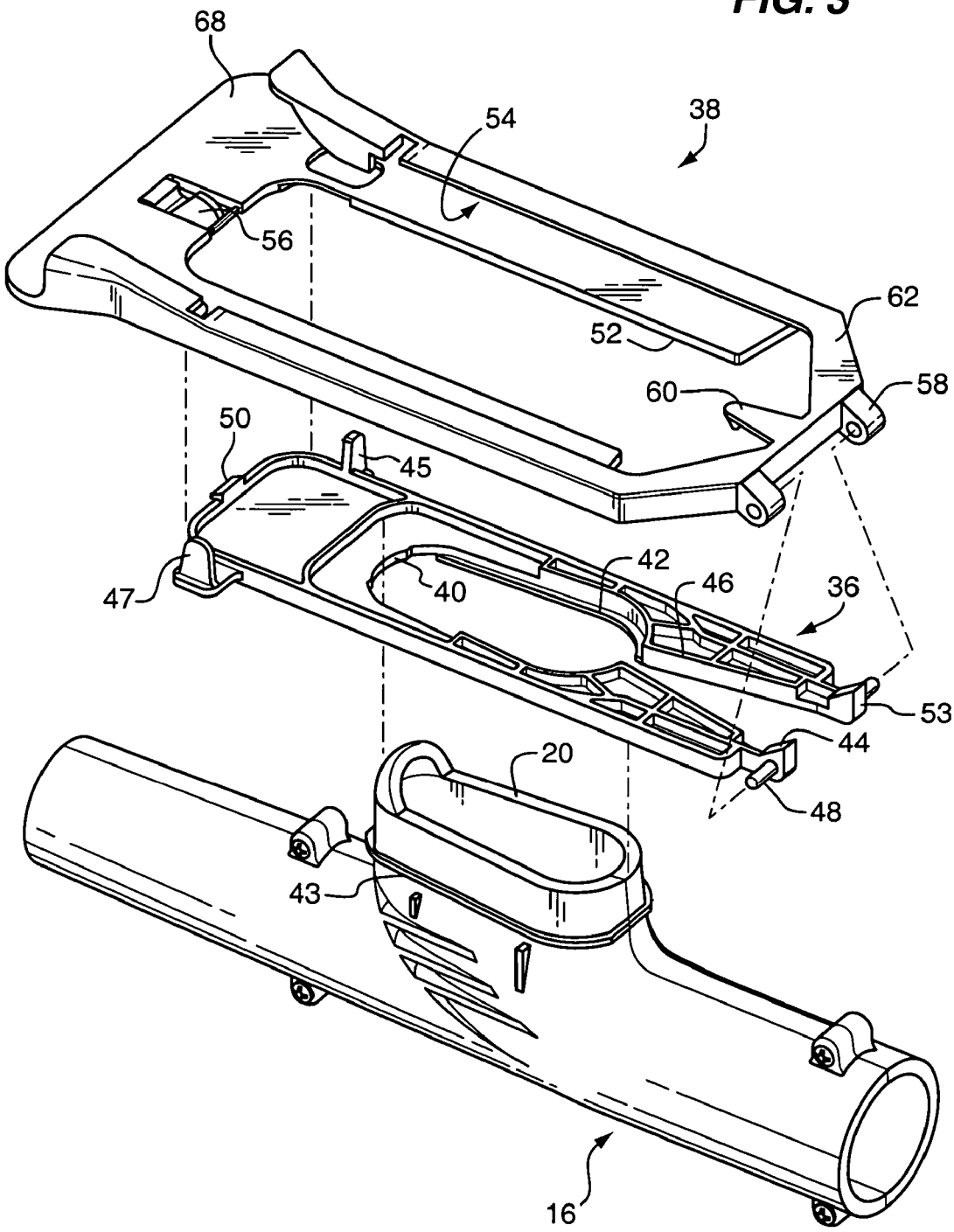
FIG. 3 is an exploded isometric view of a bag docking assembly according to one embodiment of the present invention.

FIG. 3 best illustrates one embodiment of the bag docking assembly 10. The anchor member 36 preferably takes the form of a substantially flat member composed of resilient material, preferably plastic, that is molded to have a central opening 40 for engaging the dirty air outlet nozzle 20. The central opening 40 in the anchor member 36 is larger than the dirty air outlet nozzle 20 to allow the dirty air outlet nozzle 20 to pass through the central opening 40 in the anchor member 36. In one embodiment, a portion of the central opening 40 is adapted to have a shoulder 42. The shoulder 42 forms a recess which closely and captively receives a complementary elevated portion on the dirty air outlet nozzle 20, such as a rim 43, a protrusion, or a flange.

In the preferred embodiment, the anchor member 36 is constructed to have protrusions 45 and 47 located on the perimeter of the anchor member 36. The protrusions 45 and 47 correspond to voids 21 and 23 in the bag collar (shown in FIG. 8) that are mated to one other when the bag docking assembly is closed. When the protrusions and voids are fully engaged the bag collar has been properly aligned and the bag docking assembly is able to close. In a further preferred embodiment the protrusions are horizontal 45 and vertical 47 in nature to ensure that the bag collar is not inserted upside down or backwards which would result in misalignment of the bag collar and leakage of the dirty air stream.

The anchor member 36 also has incorporated into it stops 44 for holding the mounting member 38 in an orientation that allows for the proper insertion of the bag collar. The stops 44 can be of any design but preferably they are extensions near a first hinge member 48 that allow the mounting member 38 to rotate until a portion of the mounting member 38 comes in contact with the stops 44, thus allowing the mounting member 38 to rest on the stops 44 and enable the user to install the bag. The stops also restrain the mounting member 38 from swinging fully open upon initial opening of the bag docking assembly, preventing the bag 24 from compressing against the dirty air duct 18 and expending dirt out of the bag before the collar can be closed.

In the preferred embodiment, the mounting member 38 is formed of a plastic that has been injection molded into a substantially planar body. The mounting member 38 is formed with an opening 52 that is positioned to correspond with the bag opening 26 when the collar 28 of the vacuum bag 24 is retained within the mounting member 38 in the proper position for engagement with the dirty air outlet nozzle 20 on the vacuum cleaner 12 (FIG. 2), as discussed in more detail below. In the preferred embodiment, the opening 52 in the mounting member 38 is large enough to engage the perimeter of the anchor member 36.

Figure 5:
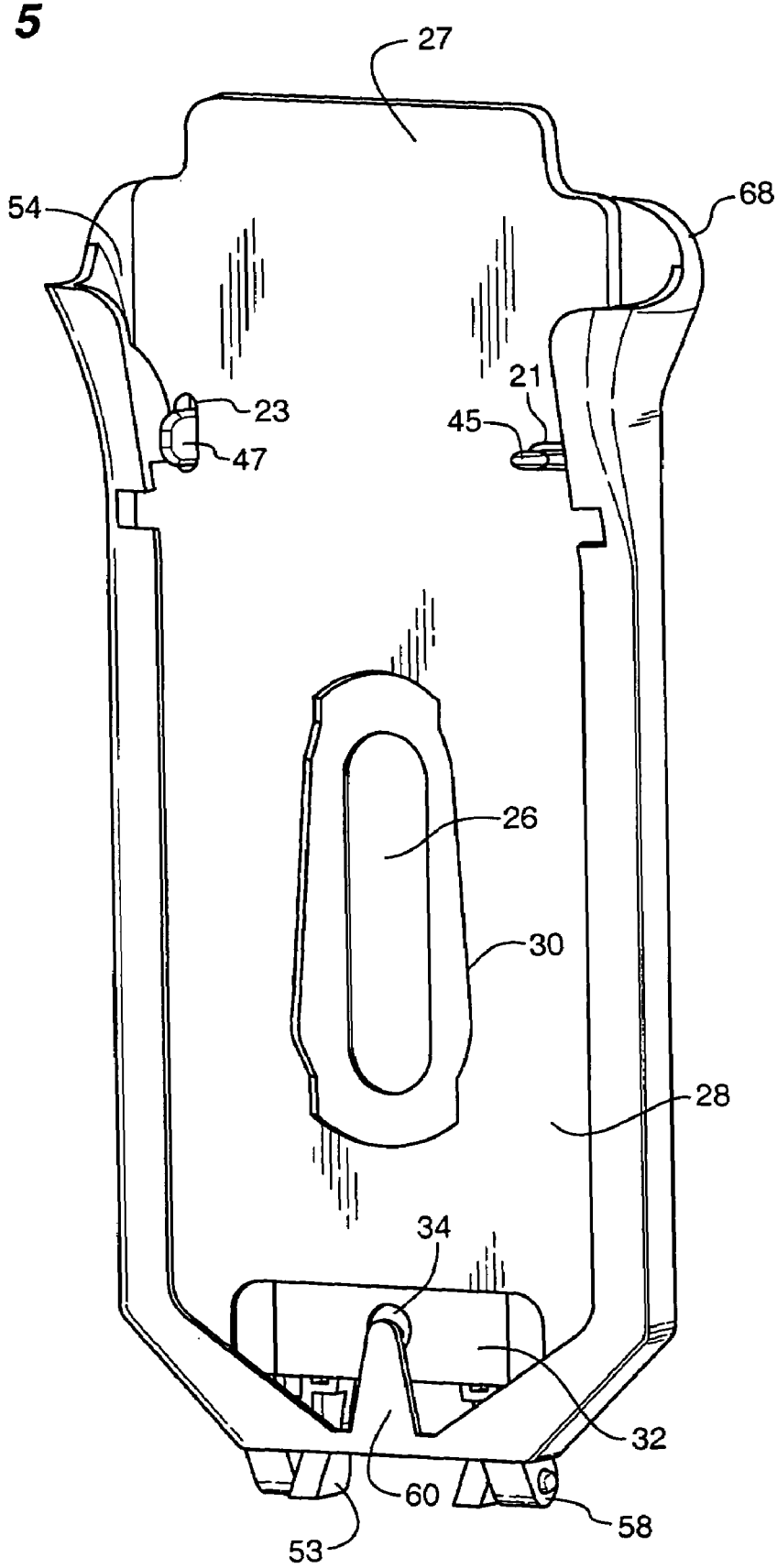
FIG. 5 is an isometric view of a bag docking assembly in a working position according to one embodiment of the present invention.

The mounting member 38 can be pivotally attached to the anchor member 36 by a hinge structure, such as a first hinge member 48 on the anchor member 36 and a second hinge member 58 on the mounting member 38. The mounting member 38 can rotate over an angle of less than 180 degrees between the point where it contacts the anchor member 36 and the point where it contacts the stops 44. A latch mechanism, such as a protrusion 56 and a material extension 50 can be utilized to retain the mounting member 38 against the anchor member 36, i.e., retain the mounting member 38 in a working position, as illustrated in FIG. 5.

Portions of the perimeter of the mounting member 38 can have one or more channels 54 for slidably receiving the edges of the collar 28 on the vacuum bag 24. The thickness of the channel 54 is slightly larger than the thickness of the collar 28 to allow the user to easily slide the collar 28 onto and off of the mounting member 38. The channels 54 may also have press features 69 formed into them to ensure that the bag collar is held tightly in the mounting member 38.

The perimeter of the mounting member 38 may also have a retainer member 60 that extends from the perimeter of the mounting member 38 toward the center of the opening 52. The retainer member 60 is positioned to engage the retainer opening 34 in the collar 28 of the vacuum bag 24.

In another embodiment, the top portion 68 of the mounting member 38 is shaped to receive a collar 28. The top portion 68 is tapered outward to allow for easier insertion of the collar 28. The tapered top portion 68 enables the user to insert the collar 28 without a time consuming search to locate the entrance of the bag dock assembly.

The anchor member 36 can be installed by first positioning the central opening 40 in the anchor member 36 directly over the dirty air outlet nozzle 20. The anchor member 36 is then pressed so that a protrusion or a rim 43 on the dirty air outlet nozzle 20 is forced through the central opening 40 in the anchor member 36. The shape of the central opening 40 in the anchor member 36 is close enough to the shape of the dirty air outlet nozzle 20 that the rim 43 on the dirty air outlet nozzle 20 retains the anchor member in its proper position for operation. The engagement of first hinge member 48 with second hinge member 58 prevents the entrance channel 44 from distorting, locking the anchor member 36 onto the dirty air outlet nozzle 20.

The anchor member 36 can also be installed by having the engagement section 44 engage the dirty air outlet nozzle 20 from a transverse direction. The neck 46 is forced over the dirty air outlet nozzle 20 and resiliently recovers its original shape, holding the anchor member 36 onto the dirty air outlet nozzle 20. The rim 43 on the dirty air outlet nozzle 20 prevents the anchor member 36 from sliding off of the end of the dirty air outlet nozzle 20.

Figure 4:
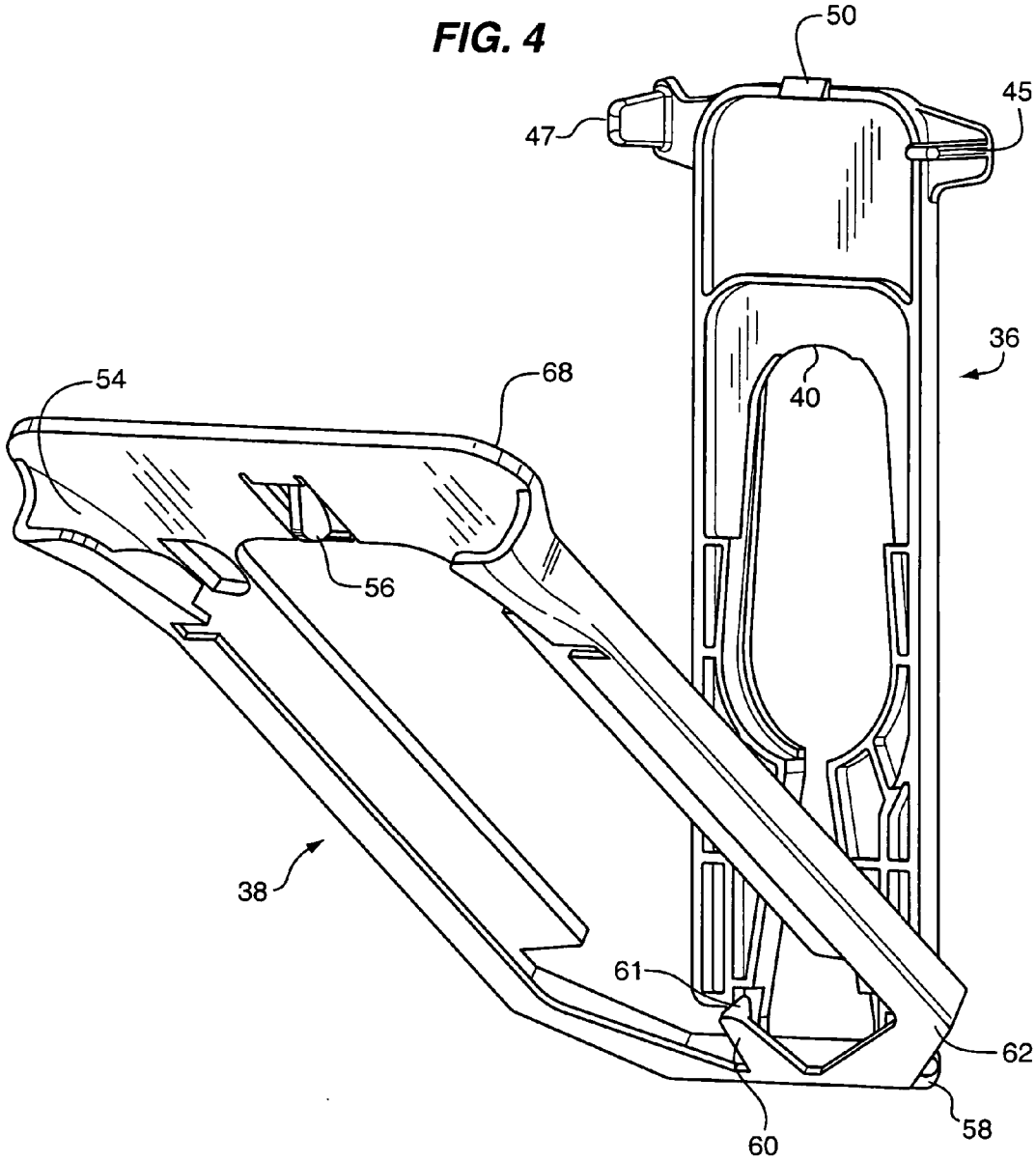
FIG. 4 is an isometric view of a bag docking assembly in a loading position according to one embodiment of the present invention.

The mounting member 38 is pivotally attached to the anchor member 36 by the engagement of the first hinge member 48 and the second hinge member 58. In the preferred embodiment, where the first hinge member 48 is positioned for use at the bottom of the anchor member 36, the pivoting axis is substantially horizontal. Consequently, the mounting member 38 can rotate to a vertical orientation, as shown in FIG. 5, in which the second hinge member 58 is at the bottom, i.e., into the working position. From the working position, the mounting member 38 can rotate to a position in which the mounting member 38 is positioned against the stops 44 on the anchor member 36, as shown in FIG. 4. Between these two positions, the mounting member 38 pivots through a number of orientations in which the mounting member 38 is directed away from the handle assembly 16 and toward the opening of the outer bag 22. In at least one of these positions, defined as a loading position, a user can remove a full vacuum bag 24 from the mounting member 38 and replace it with a new vacuum bag 24.

Figure 6:
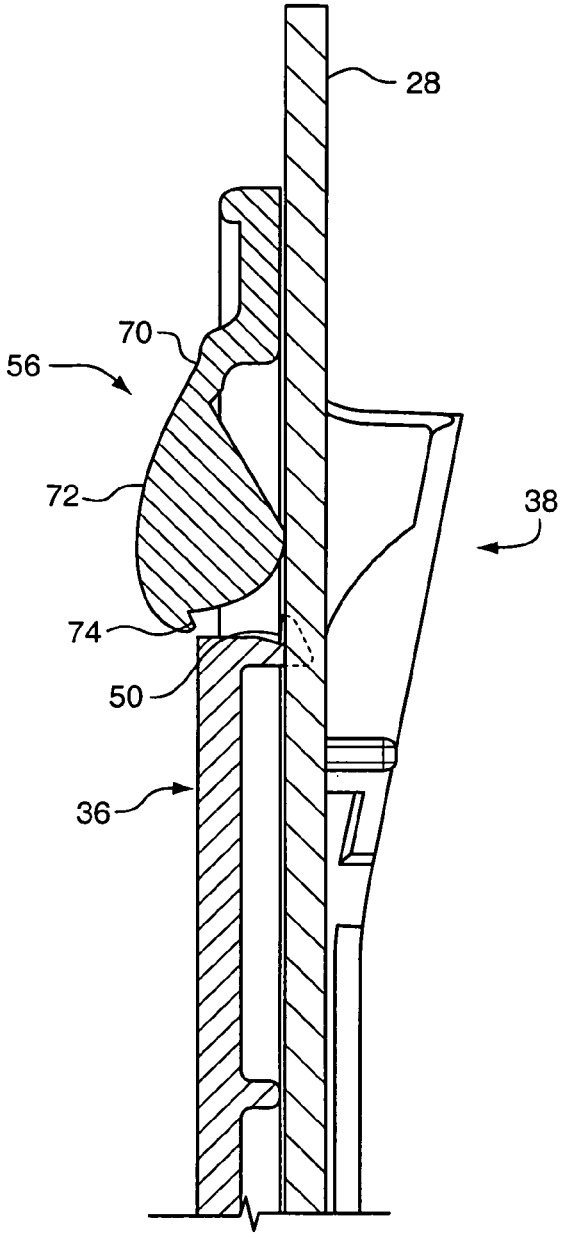
FIG. 6 is a side view of a bag docking system in a working position when bag has been properly inserted according to one embodiment of the present invention.
Figure 7:
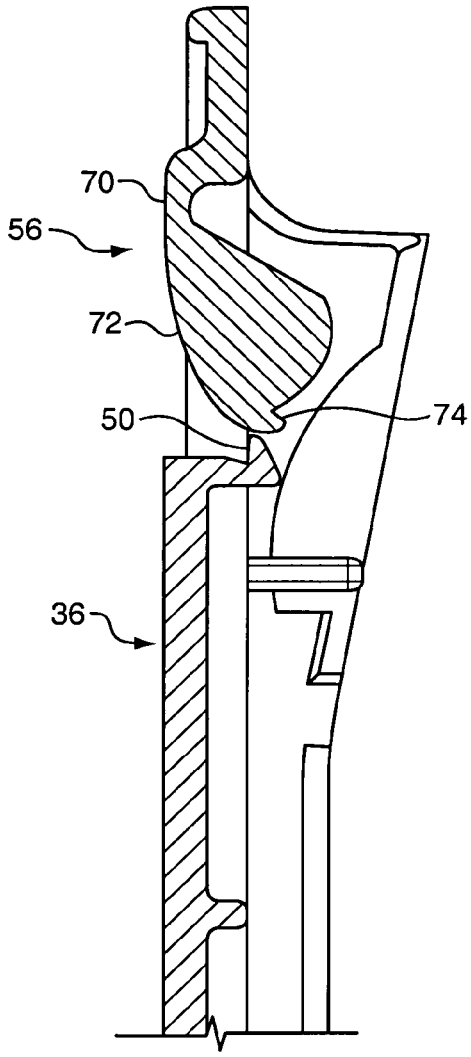
FIG. 7 is a side view of a bag docking system in a working position when bag has been improperly inserted according to one embodiment of the present invention.

In a preferred embodiment, as shown in FIGS. 6 and 7, the mounting member can be retained against the anchor member by a preload latch design. The latch 56 consists of a hinged portion 70, which connects the planar body of the anchor member 36 to latch 56, an enlarged portion 72, which is actuated into a preloaded position when a bag collar 28 is correctly inserted into the bag docking assembly, and a notch portion 74 that engages with extension 50 on the anchor member 36. As shown in FIG. 6 when a collar is correctly inserted into the bag docking assembly the bag collar 28 preloads the latch enabling the latch to move past the extension 50. If the bag collar 28 is not inserted in the correct manner, as shown in FIG. 7, the latch 56 is not preloaded and will not move past extension 50, thus preventing the user from closing the bag docking assembly.

The vacuum bag 24 can be engaged with the bag docking assembly by inserting the collar 28 into the top portion 68 between the channels 54 on the mounting member 38. When the vacuum bag 24 is fully engaged with the mounting member 38, the bag opening 26 aligns with the opening 52 in the mounting member 38 and the voids 21 and 23 of bag collar 28 align with the protrusions 45 and 47 on the anchor member 36. When the bag docking assembly is rotated into the working position, the bag opening 26 aligns with and engages the dirty air outlet nozzle 20 and the bag collar voids 21 and 23 align and engage with the protrusions 45 and 47.

Figure 9:
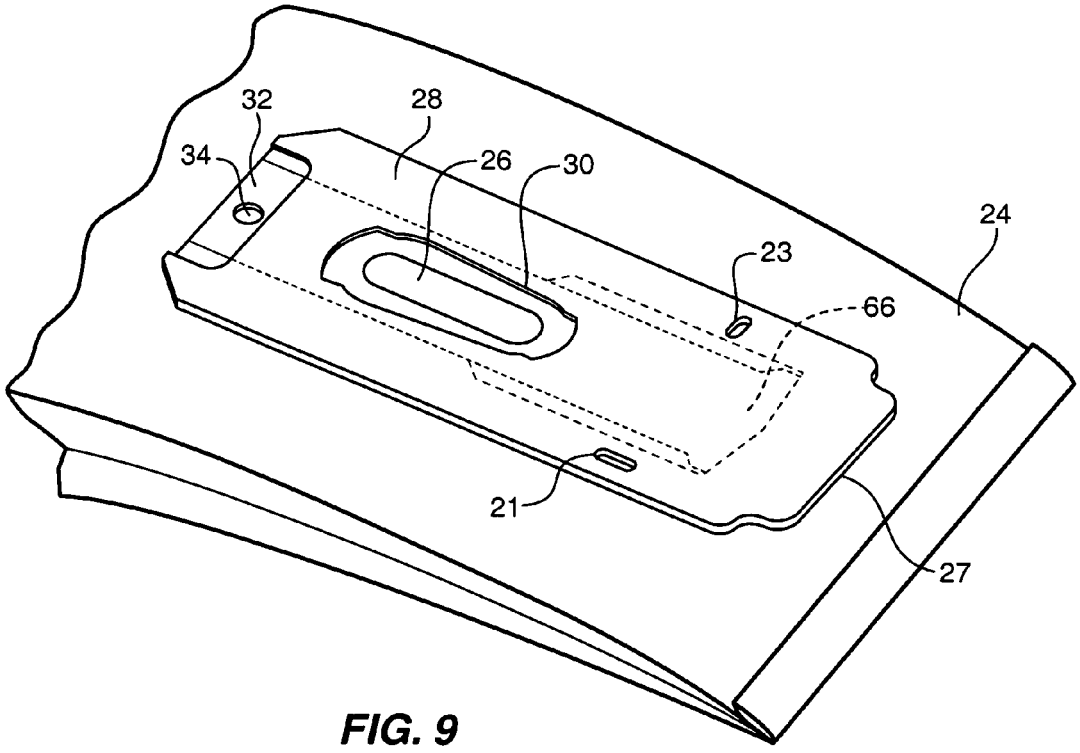
FIG. 9 is an isometric view of a vacuum bag collar according to yet another embodiment of the present invention.

In one embodiment, the collar 28 is formed to have a sliding panel 32 that can move between an open and a closed position across the bag opening 26 (FIG. 9). The retainer member 60 has a substantially hemispherical portion 61 at its distal end that engages the retainer opening 34 when the collar 28 is fully engaged with the mounting member 38. The engagement of the retainer member 60 with the retainer opening 34 operates to close the sliding panel 32 over the bag opening 26 upon removal of the vacuum bag 24 from the mounting member 38. When the user removes the vacuum bag 24 from the mounting member 38 via the contoured top portion 27, the hemi-spherical portion 61 of the retainer member 60 resists the force exerted by the user. The force necessary to move the sliding panel 32 is less than the force necessary to disengage the retainer member 60 from the retainer opening 34. As a result, the sliding panel 32 remains stationary as the collar 28 is removed from the mounting member 38. Once the sliding panel 32 is fully closed over the bag opening 26, a positive stop 66 in the collar 28 prevents the sliding panel 32 from sliding further. At this point, all of the force exerted by the user is transferred to the retainer member 60. This additional force frees the retainer opening 34 from the retainer member 60 and disengages the vacuum bag 24 from the mounting member 38.

Figure 8:
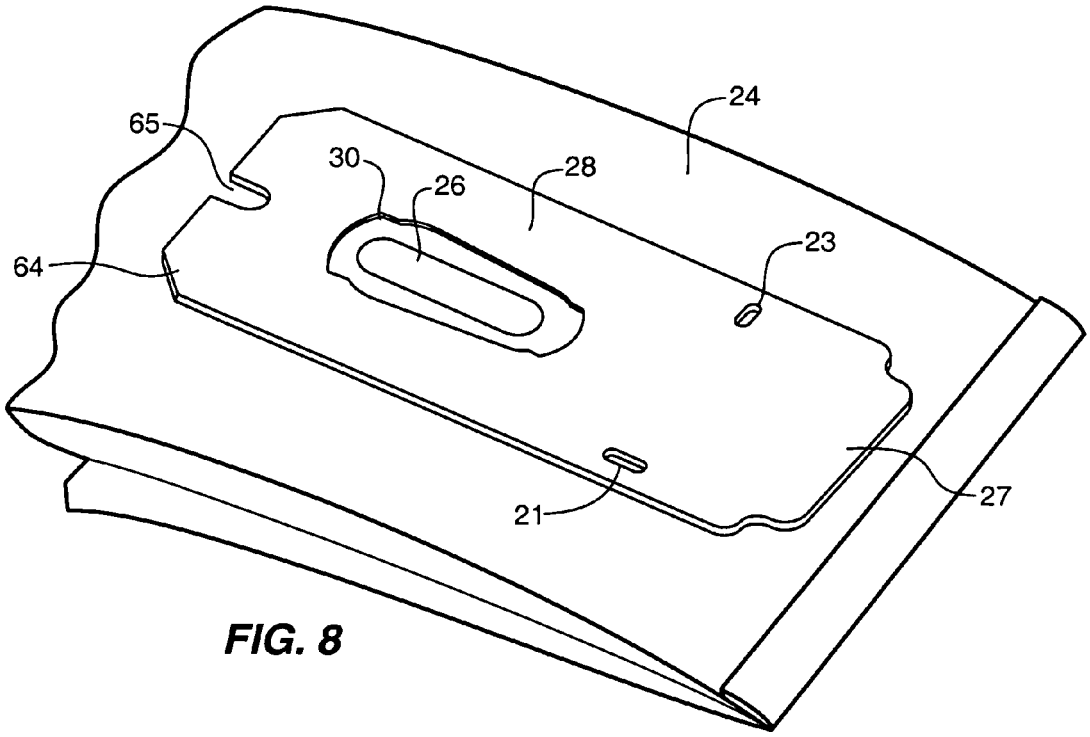
FIG. 8 is an isometric view of a vacuum bag collar according to another embodiment of the present invention.

In another embodiment, the collar 28 has a recess 65 constructed to surround the retainer member 60 when the collar 28 is engaged with the mounting member 38 (FIG. 8). The collar 28 does not have a sliding panel 32. Consequently, the recess 65 prevents the retainer member 60 from interfering with the collar 28.

From the foregoing it will be appreciated that, although specific embodiments of the invention have been described herein for purposes of illustration, various modifications may be made without deviating from the spirit and scope of the invention.

We claim:

1. A method for installing a vacuum bag, comprising:

inserting a collar of the vacuum bag into a mounting member;

rotating the mounting member from a loading position towards a closed position;

allowing the mounting member to reach a fully closed position when the collar of the vacuum bag is in a correct orientation by passing at least one protrusion through a corresponding void in the collar where the at least one protrusion is in addition to a dirty air nozzle.

2. The method for installing a vacuum bag of claim 1, further comprising:

latching the mounting member into the fully closed position.

3. The method for installing a vacuum bag of claim 1, further comprising:

preventing the mounting member from reaching the fully closed position when the collar of the vacuum bag is in an incorrect orientation by interfering with a solid area of the collar with the at least one protrusion.

4. The method for installing a vacuum bag of claim 1 where the collar is inserted into a channel in the mounting member.

5. A method for manufacturing a vacuum bag, comprising:

cutting a collar from a flat stock of a generally stiff material where the collar has a first opening configured to accept a dirty air nozzle, a second opening elongated in a first direction, a third opening elongated in a second direction and where the second and third openings are configured to allow the vacuum bag to be moved into a fully installed position onto the dirty air nozzle when the collar is in a correct orientation;

attaching the collar to an air permeable bag.

6. A method for manufacturing a vacuum bag, comprising:

cutting a collar from a flat stock of a generally stiff material where the collar has a dirty air opening, at least one void separate from the dirty air opening for engaging at least one protrusion on an anchor member of a bag docking assembly, and a retainer opening;

attaching the an air-permeable bag to the collar.

7. A vacuum bag comprising:

a generally flat collar;

a first opening in the collar configured to accept a dirty air nozzle;

a second opening in the collar elongated in a first direction;

a third opening in the collar elongated in a second direction where the second and third openings are configured to allow the vacuum bag to be moved into a fully installed position onto the dirty air nozzle when the collar is in a correct orientation.

8. The vacuum bag of claim 7 wherein the first direction is a vertical direction and the second direction is a horizontal direction.

9. The vacuum bag of claim 7 wherein the collar has an end edge, a first side edge, a second side edge opposing the first side edge, an orientation surface and the first and second side edges are in a generally vertical orientation during use, the end edge is in a generally horizontal orientation during use, the first and second side edges are free from the bag, the orientation surface comprises an angled surface extending from the first side edge to the end edge, and the orientation surface is adapted to aid in orientating the opening of the bag.

10. The vacuum bag of claim 9, wherein the orientation surface comprises a chamfered corner of the collar.

11. The vacuum bag of claim 9, wherein the collar includes a second orientation surface extending from the second side edge to the end edge.

12. The vacuum bag of claim 7, wherein the collar further includes an elastic seal surrounding the first opening.

13. The vacuum bag of claim 7, wherein the collar further includes a sliding panel that slides between an open position and a closed position over the first opening.

14. The vacuum bag of claim 13, wherein the collar further includes a positive stop limiting the movement of the sliding panel.

15. A vacuum cleaner comprising;

a dirty air nozzle;

a vacuum bag having a substantially rigid collar having a dirty air opening, wherein the rigid collar has at least one void, in addition to the dirty air opening, used for alignment of the collar;

a mounting member releasably connected to the vacuum cleaner and movable between a loading position in which the vacuum bag is inserted into or removed from the mounting member and a fully closed position in which the dirty air nozzle engages the dirty air opening in the collar of the vacuum bag;

at least one protrusion fixedly positioned adjacent to the dirty air nozzle and configured to preventing the mounting member from reaching the fully closed position when the collar of the vacuum bag is in an incorrect orientation by interfering with a solid area of the collar, the at least one protrusion allowing the mounting member to reach the fully closed position when the collar of the vacuum bag is in a correct orientation by passing through the corresponding at least one void.

16. The vacuum cleaner of claim 15 further comprising:

a stop that limits the mounting member from moving past the loading position.

17. The vacuum cleaner of claim 15 wherein the mounting member has an inlet which is tapered outward.

18. The vacuum cleaner of claim 15 further comprising:

a latch operable to releasably retain the mounting member in the fully closed position.

19. The vacuum cleaner of claim 18 wherein the latch is designed with a preload so as to become inoperable if the at least one void is not engaged with the at least one protrusion.

20. The vacuum cleaner of claim 15 further comprising a retainer member attached to the mounting member for engaging a retainer opening in the vacuum bag.

21. The vacuum cleaner of claim 15 wherein the rigid collar further comprises a contoured portion to allow for grasping of the collar without interference by the mounting member.

22. The vacuum cleaner of claim 15 further comprising a second protrusion in adjacent to the dirty air nozzle wherein the at least one protrusion has a dissimilar size, shape or orientation than the second protrusion.

23. The vacuum cleaner of claim 22 wherein the protrusions are elongated.

24. The vacuum cleaner of claim 23 wherein the at least one protrusion is elongated in a horizontal orientation and the second protrusion is elongated in a vertical orientation.

* * * * *